US006488424B1

(12) United States Patent
Yoshifuji

(10) Patent No.: US 6,488,424 B1
(45) Date of Patent: Dec. 3, 2002

(54) IMAGE FORMING DEVICE

(75) Inventor: Tomonobu Yoshifuji, Mitaka (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 09/402,058

(22) PCT Filed: Apr. 6, 1998

(86) PCT No.: PCT/JP98/01574

§ 371 (c)(1),
(2), (4) Date: Feb. 2, 2000

(87) PCT Pub. No.: WO98/45198

PCT Pub. Date: Oct. 15, 1998

(30) Foreign Application Priority Data

Apr. 4, 1997 (JP) ..... 9-086342
Apr. 4, 1997 (JP) ..... 9-086343

(51) Int. Cl.[7] ..... B41J 13/10
(52) U.S. Cl. ..... 400/596; 400/642
(58) Field of Search ..... 400/596, 595, 400/642, 644, 636, 624, 625

(56) References Cited

U.S. PATENT DOCUMENTS 4,794,404 A * 12/1988 Shiraishi et al. ..... 400/636
5,116,034 A * 5/1992 Trask et al. ..... 271/2
5,478,162 A * 12/1995 Nakayama et al. ..... 400/624
5,730,537 A * 3/1998 Kelly et al. ..... 400/625
5,772,343 A * 6/1998 Beretta et al. ..... 101/234
5,833,381 A * 11/1998 Kellogg et al. ..... 400/642
6,027,270 A * 2/2000 Greive ..... 400/625
6,029,020 A * 2/2000 Blackman et al. ..... 399/45

FOREIGN PATENT DOCUMENTS

| | | | |
|---|---|---|---|
| JP | 2-58953 | 4/1990 | |
| JP | 8-12158 | 1/1996 | |
| JP | 8-295445 | 11/1996 | |
| JP | 9-39323 | 2/1997 | |
| WO | 9112968 | * 9/1991 | ..... 400/596 |

* cited by examiner

*Primary Examiner*—Andrew H. Hirshfeld
*Assistant Examiner*—Anthony H. Nguyen
(74) *Attorney, Agent, or Firm*—Dellett and Walters

(57) ABSTRACT

A second passage 20 is arranged on a side opposite to a discharge port 16 relative to a first passage 18. Additionally, an intercepting member 24 is provided which intercepts the communication between the first passage 18 and the insertion port 14 and allows the insertion port 64 to communicate only with the second passage 20, at a portion of the first passage 18 near the insertion port 14, whereby the intercepting member 24 intercepts the communication between the first passage and the insertion port 14 at a prescribed timing.

5 Claims, 12 Drawing Sheets

IMAGE FORMING DEVICE

TECHNICAL FIELD

The present invention relates to an image formation apparatus such as copying machines, printers, and plotters.

BACKGROUND TECHNIQUE

As the output apparatus of computers and work stations, there are known ink-jet type image formation apparatuses which form images by ejecting an ink onto a recording medium like a recording paper sheet, and electrophotography type image formation apparatuses which forms images by use of a developing agent on a recording medium. Some of such image formation apparatuses have an insertion port for inserting a recording medium and a discharge port for discharging the recording medium on the same side, and have a passage for introducing the recording medium to the insertion port on the same side as the ports. Some of the image formation apparatuses have a detection sensor near the insertion port for detecting the recording medium to measure the length of the recording medium in formation of the image on the recording medium.

Such an image formation apparatus having the aforementioned passage and the detection sensor measures the length of the recording medium by detecting with the sensor the front end of the recording medium inserted through the passage and the insertion port, delivering further the recording medium toward the discharge port, and detecting with the sensor the rear end of the recording medium. Thus the length of the recording medium is measured by detection of the front end and the rear end of the recording medium by the detection sensor. After the length measurement of the recording medium by detection of the front end and the rear end, the recording medium is delivered back from the discharge port toward the insertion port (in the direction reverse to the length measurement direction), thereby the recording medium is set in a standby state for printing.

However, in the case where the discharge port is placed above the insertion port and the recording medium is long, the recording medium may hang down from the discharge port to come close to the passage at the time when the length measurement is completed by detection of the rear end of the recording medium delivered through the passage and the insertion port. After the length measurement, the recording medium is sent back in the direction reverse to the length measurement to be ready for printing. In this state, the rear end portion of the recording medium may reach the passage. Thereby, the rear end of the recording medium may be brought into contact with the front end thereof, and may be wound by the front end to introduce the rear end into the discharge port to cause paper jamming undesirably. Such jamming can occur even with the insertion port placed above the discharge port, if the rear end portion of the recording medium hangs down.

Furthermore, some of the ink-jet type or the electrophotography type of image formation apparatuses have the insertion port for inserting the recording medium and the discharge port for discharging the recording medium on the same side, and additionally an insertion table on the same side for introducing the recording medium into the insertion port.

For inserting the recording medium into the insertion port for delivery, the recording medium is laid on the insertion table, and is introduced therefrom into the insertion port. A detection sensor is placed near the insertion port to detect the recording medium. On detection of the front end of the recording medium by this detection sensor, the delivery roller starts to deliver the recording medium.

Some of the image formation apparatuses having the insertion table and the detection sensor as mentioned above form the image on the recording medium after measurement of the sheet length of the recording medium. In such an image formation apparatus, the recording medium is introduced from the insertion table into the insertion port; the front end of the recording medium is detected by the sensor; the recording medium is delivered toward the discharge port; and the rear end is detected by the sensor. In such a manner, the length of the recording medium is derived by detection of the front end and the rear end. The recording medium after the length measurement is delivered back from the discharge port toward the insertion port (in the direction reverse to the length measurement) to be set in a standby state for printing.

However, in the case where the discharge port is placed above the insertion port and the recording medium sheet is long, the front end portion of the recording medium may possibly hang down from the discharge port onto the insertion table and may be inserted again into the insertion port to cause paper jamming. Such jamming is liable to be caused in image formation on a long sheet of the recording medium.

Such jamming can be prevented by providing a guide or a like member to lead the recording medium discharged from the discharge port to be isolated from the insertion port.

However, if the recording medium curls as a whole or the front end thereof is curled by moisture absorption or another cause, the recording medium, which is discharged from the discharge port to a position distant to the insertion port, can hang down onto the insertion table again and be drawn into the insertion port to cause jamming.

DISCLOSURE OF THE INVENTION

The present invention intends to provide an image formation apparatus which does not cause paper jamming, under the above situations.

A first embodiment of the image formation apparatus of the present invention for achieving the above object, has an insertion port for inserting a recording medium and a discharge port for discharging the recording medium provided on the same side, and a first passage for guiding the recording medium to the insertion port also on the same side as above, wherein (1) the apparatus has a second passage provided on a side opposite to the discharge port relative to the first passage and communicating with the insertion port.

(2) The first passage and the second passage preferably join together near the insertion port, and (3) an intercepting member is preferably provided which intercepts the communication between the first passage and the insertion port at a prescribed timing to allow the insertion port to communicate only with the second passage.

A second embodiment of the image formation apparatus of the present invention for achieving the above object has an insertion port for insertion of a recording medium and a discharge port for discharging the recording medium provided on the same side, and an insertion table for guiding the recording medium to the insertion port also on the same side as above, wherein (4) the insertion table has a stair at the border between a portion near to the insertion port and an adjacent portion distant from the insertion portion, and (5) the apparatus has preferably a blocking member for blocking the space communicating with the insertion port at a prescribed timing at or around the stair.

BEST MODE FOR CARRYING OUT THE INVENTION

The present invention is explained by reference to drawings, taking as an example an ink-jet type image formation apparatus.

Figure 1:
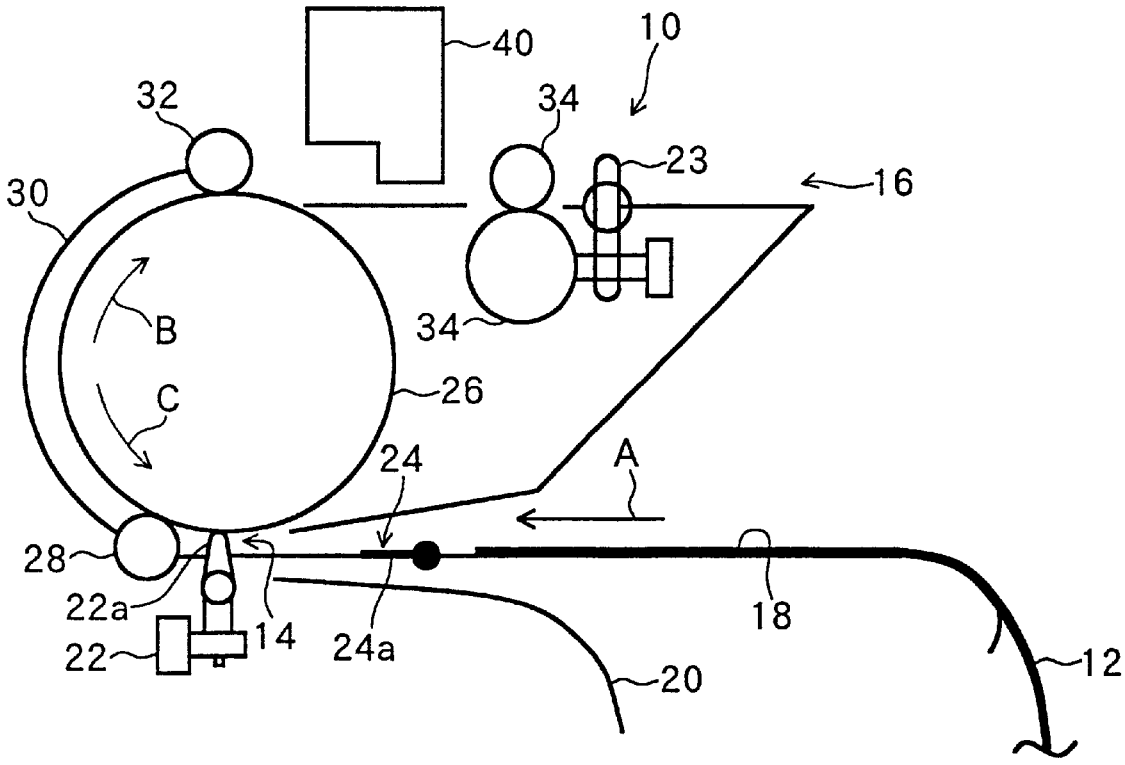
FIG. 1 illustrates schematically an ink-jet type image formation apparatus of a first embodiment in a state that the front end of a recording medium is placed in a first passage.
Figure 2:
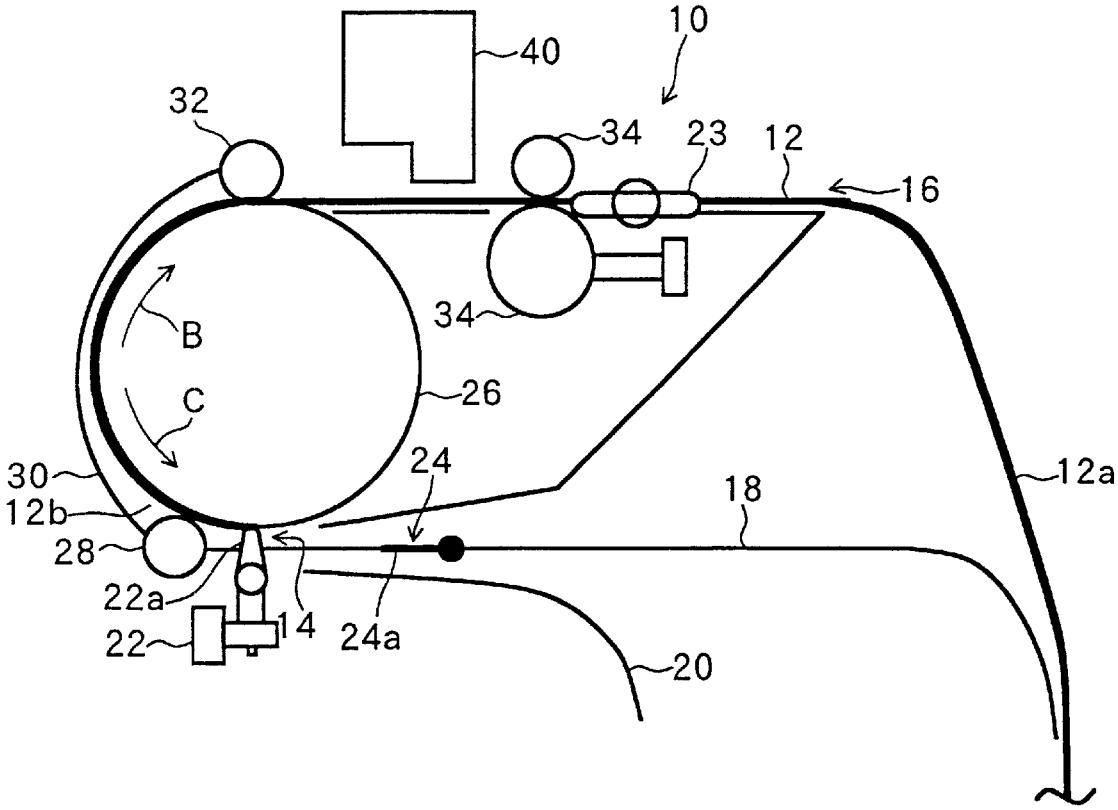
FIG. 2 illustrates schematically the ink-jet type image formation apparatus in a state that the rear end of the recording medium is detected by a detection sensor.
Figure 3:
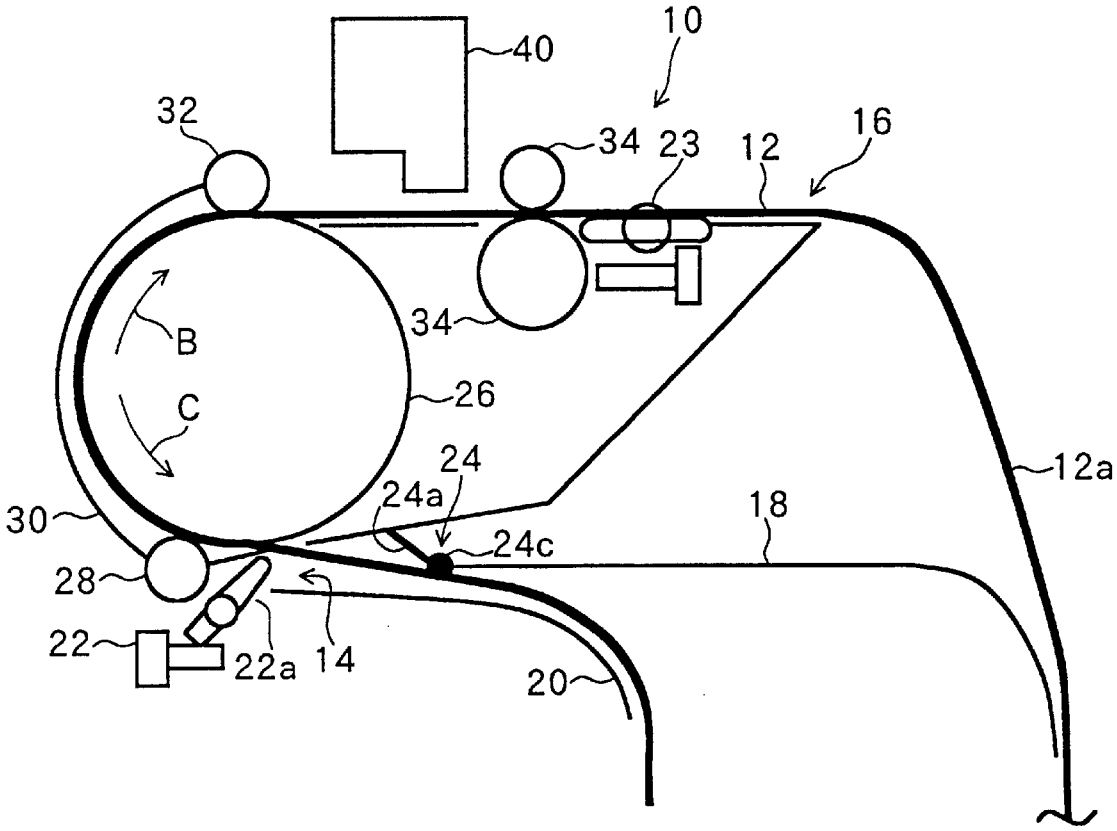
FIG. 3 illustrates schematically the ink-jet type image formation apparatus in a state that the recording medium is guided into a second passage.

FIGS. 1–3 illustrate schematically constitution of an ink-jet type image formation apparatus of a first embodiment of the present invention. FIG. 1 illustrates a state of the front end of a recording medium placed in a first passage. FIG. 2 illustrates a state of the rear end of the recording medium detected by a detection sensor. FIG. 3 illustrates the state of the recording medium guided into a second passage.

In ink-jet type image formation apparatus 10, insertion port 14 for inserting recording medium (paper) 12, and discharge port 16 for discharging recording medium 12 are provided on the same side. First passage 18 for introducing recording medium 12 to insertion port 14 is provided on the same side as insertion port 14. Second passage 20 is provided on the side opposite to discharge port 16 relative to first passage 18, and this second passage 20 communicates with insertion port 14. These first and second passages 18,20 are joined together in the vicinity of insertion port 14. In a portion of insertion port 14 near the joining part, detection sensor (photointerrupter) 22 is provided for measuring the length of recording medium 12 for image formation thereon. The length of recording medium is measured by detecting the front end and the rear end of recording medium 12 and treating the detection signals by a computing element (not shown in the drawings).

In a portion of first passage 18 near to insertion port 14, intercepting member 24 is provided which intercepts the communication between first passage 18 and insertion port 14 and allows communication of insertion port 14 with second passage 20 only. This intercepting member 24 intercepts the communication between first passage 18 and insertion port 14 at the timing shown later. Another detection sensor (photointerrupter) 23 is provided between paper discharging roller 34 and discharge port 16. Printing head 40 is provided between delivery roller 32 and paper discharge roller 34. The printing head 40 forms an image by ejection of ink by reciprocation movement in a direction perpendicular to the drawing paper sheet of FIG. 3.

Figure 4:
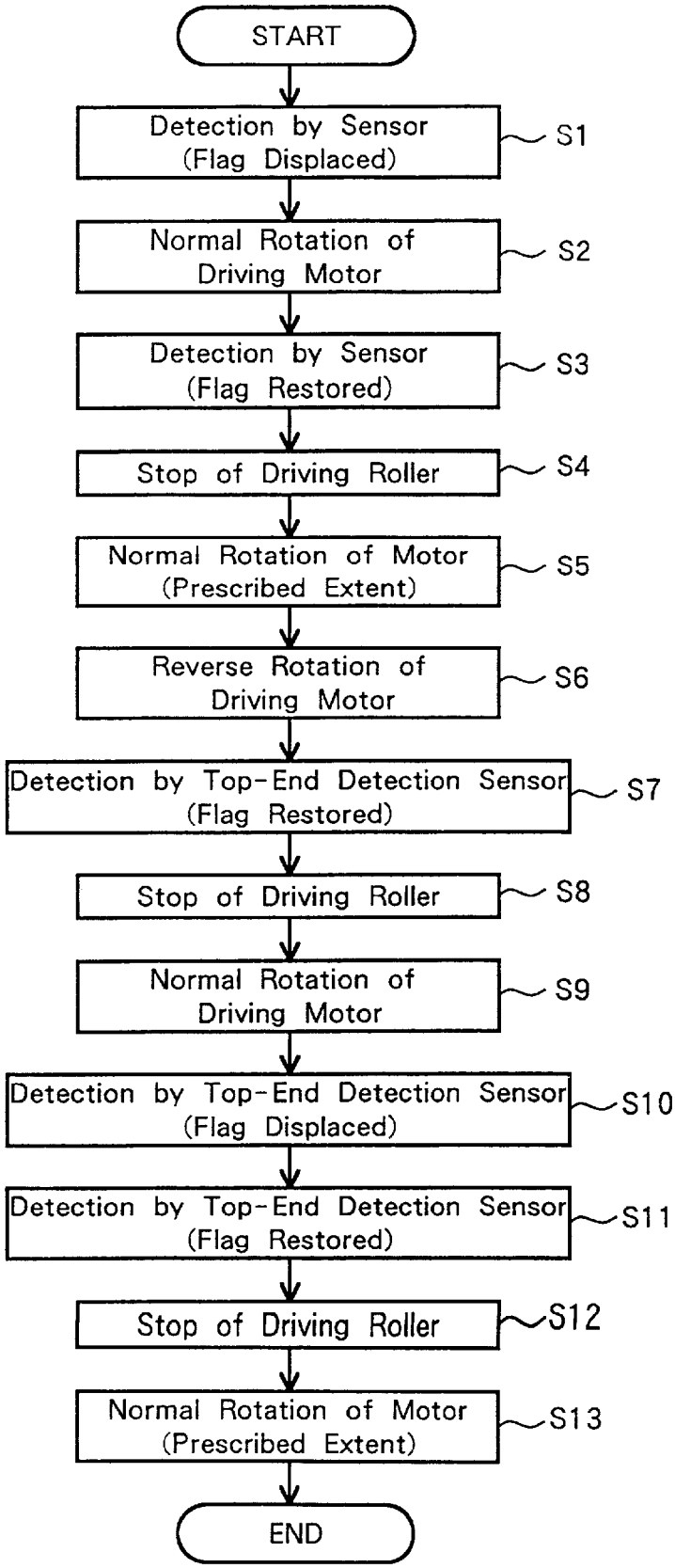
FIG. 4 is a flow chart showing the steps of forming an image on a recording medium by the ink-jet type image formation apparatus illustrated in FIG. 1.

The steps of formation of an image on recording medium 12 with the ink-jet type image formation apparatus illustrated in FIG. 1 is explained by reference to FIG. 4.

In printing with ink-jet type image formation apparatus 10, the length of recording medium 12 is measured prior to formation of an image on recording medium 12. The measurement of the length of recording medium 12 is conducted as follows. Recording medium 12 is placed on first passage 18 and is inserted in the arrow-A direction into insertion port 14 as shown in FIG. 1 to allow recording medium 12 to push detection sensor 22. By the pushing action against the detection sensor 22 by recording medium 12, sensor portion 22*a* of detection sensor 22 is tilted, thereby detecting the front end of recording medium 12 (S1), and starting driving roller 26 to rotate in the normal direction (normal rotation) (S2). By this rotation, recording medium 12 held between driving roller 26 and delivery roller 28 is delivered by driving roller 26 and guide plate 30. Recording medium 12 is further held and delivered by a pair of rollers 34 to discharge port 16. In such a manner, recording medium 12 is held between driving roller 26 and delivery rollers 28,32, and between discharge rollers 34, and comes to be sent out through discharge port 16. At the time when the front end portion 12*a* is discharged from discharge port 16 and hangs down, and the rear end of recording medium 12 has passed detection sensor 22*a* shown in FIG. 2, tilted sensor portion 22*a* restores to the original state to detect the rear end of recording medium 12 (S3). On detection of the front and the rear end of recording medium 12, the detection signals are treated by computing element (not shown in the drawings) to derive the length of recording medium 12, and driving roller 26 is stopped once (34).

At the time when driving motor 26 has once stopped (an example of the "prescribed timing" in the present invention), motor 24*b* (see FIG. 5) is rotated by a prescribed extent (S5) to raise interception plate 24*a* of intercepting member 24 to intercept the communication between first passage 18 and insertion port 14 as shown in FIG. 3. Thereby, insertion port 14 communicates only with second passage 20. Thereafter, driving roller 26 is rotated in the arrow-C direction (reverse rotation) (S6). By this rotation, recording medium 12 having been delivered by driving roller 26 and delivery rollers 28,32 is guided to second passage. When the front end of recording medium 12 has been detected by detection sensor 23 (S7), driving roller is stopped once, and recording medium 12 is in a state of standby for printing (S8).

For returning recording medium 12 to the standby state for the printing by the reverse rotation of driving roller 26, intercepting plate 24*a* of intercepting member 24 intercepts the communication between first passage 18 and insertion 14 to communicate insertion port 14 with second passage 20 only, so that recording medium 12 is guided to the second passage. When recording medium 12 begins to be guided to the second passage, front end portion 12*a* of recording medium 12 is still hanging down from discharge port 16 to be close to first passage 18. However, since recording medium 12 is guided to the second passage, the rear end portion of recording medium 12 cannot be caught and wound by front end portion 12*a* of recording medium 12. Thereby, recording medium 12 does not enter discharge port 16, which prevents paper jamming.

When recording medium 12 has returned to the standby state and driving roller 26 has stopped once (S8), driving roller 26 is started to rotate in the normal direction (S9). During the printing, detection sensor is detecting continuously recording medium 12 (S10). When the rear end of recording medium 12 has been passed detection sensor 23 after completion of the printing, detection sensor 23 comes to be turned off (S11), and driving roller 26 is stopped according to the signal showing the turning-off of detection sensor 23 (S12). Thereafter, motor 24*b* (see FIG. 5) is turned by a prescribed extent to lower interception plate 24*a* of intercepting member (S13). Thereby, first passage 18 is allowed to communicate with insertion port 14 for insertion of recording medium 12 from first passage 18.

Intercepting member 24 is explained by reference to FIG. 5.

Figure 5:
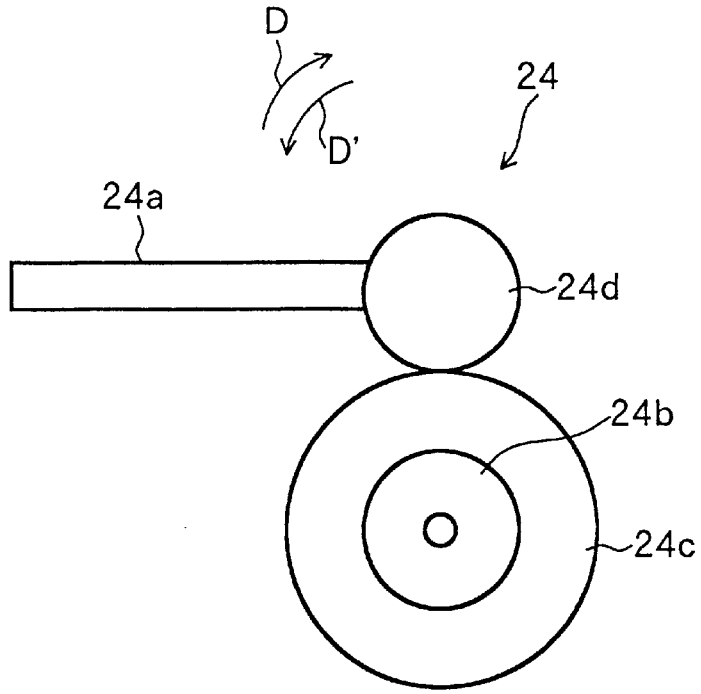
FIG. 5illustrates schematically an intercepting member.

FIG. 5 illustrates schematically an intercepting member.

Intercepting member 24 comprises motor 24*b*, and a gear 24*c* fixed to the rotation axis of this motor 24*b*. Gear 24*c* engages with gear 24*d*. Interception plate 24*a* is fixed to pivot of gear 24*d*, and interception plate 24*a* is turned by rotation of motor 24*b* in the directions of arrows D and D'. While recording medium 12 on first passage 18 (see FIG. 1) is inserted into insertion port 14, interception plate 24*a* is placed at the position shown in FIG. 5 to communicate first passage 18 with insertion port 14. On detection of the rear end of recording medium 12 by detection sensor 22, motor 24*b* rotates to turn interception plate 24*a* in the arrow D direction to intercept the communication between first passage 18 and insertion port 14.

In this example, intercepting member 24 is constituted of motor 24*b*, gears 24*c*,24*d*, and other parts. However, intercepting member 24 may be constituted of interception plate 24*a* and a spring. In this constitution, interception plate 24*a* is slightly energized by the spring in the arrow-D direction. With such slight energization of interception plate 24*a* in the arrow-D direction, recording medium 12 which has been inserted into insertion port 14 through first passage 18 can pass through by pushing interception plate 24*a*. When the rear end of recording medium 12 has passed interception plate 24*a*, the communication between first passage 18 and insertion port 14 is intercepted owing to the energization of interception plate 14*a* in the arrow-D direction by the spring. Otherwise, interception member 24 may be constituted to serve also as detection sensor 22.

Figure 7:
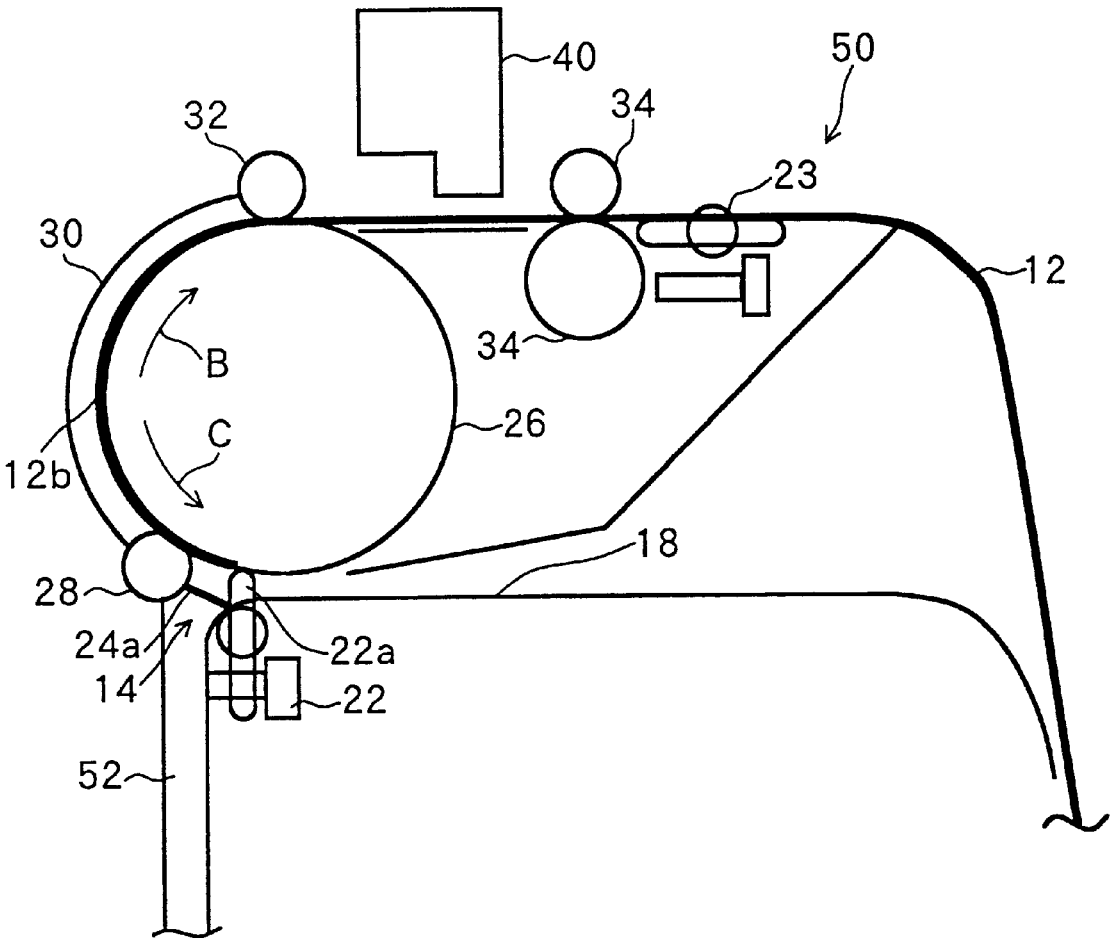
FIG. 7 illustrates schematically the ink-jet type image formation apparatus shown in FIG. 6 in a state that the rear end of the recording medium is detected.
Figure 8:
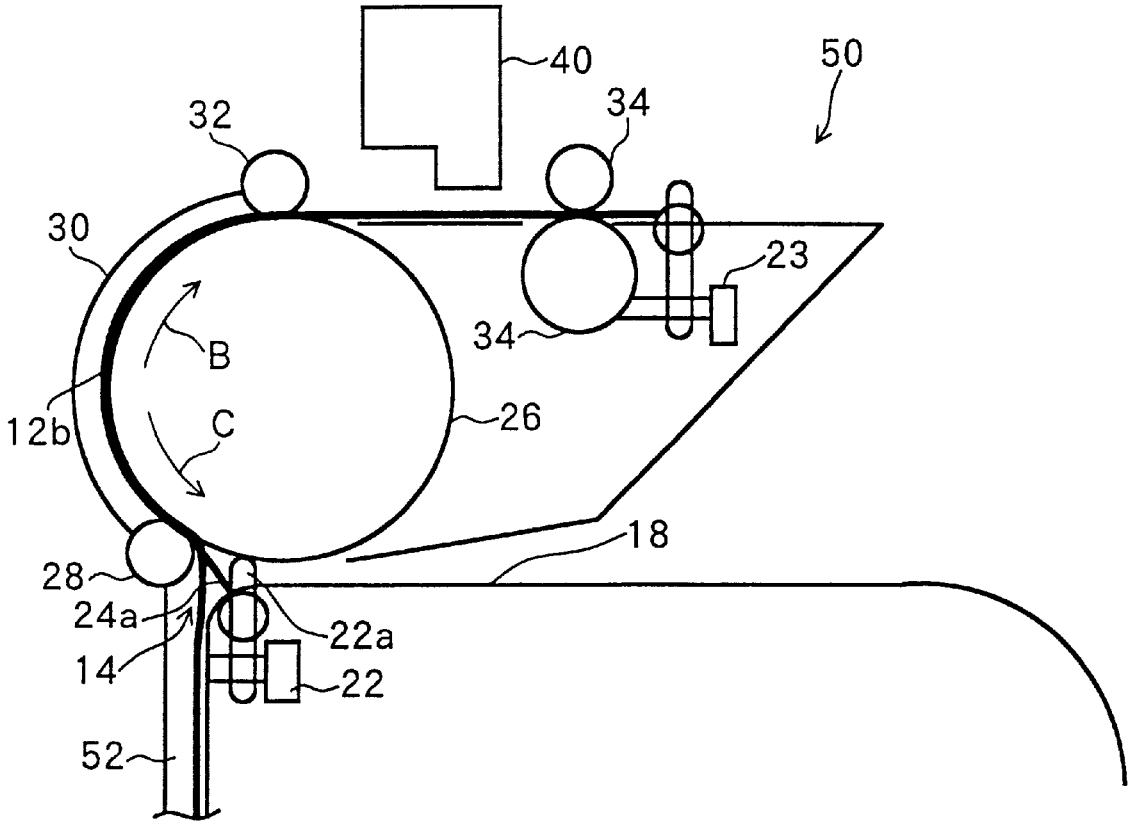
FIG. 8 illustrates schematically the ink-jet type image formation apparatus shown in FIG. 6 in a state that the recording medium is guided to a second passage.

A second embodiment of the image formation apparatus of the present invention is explained below by reference to FIGS. 6–8.

Figure 6:
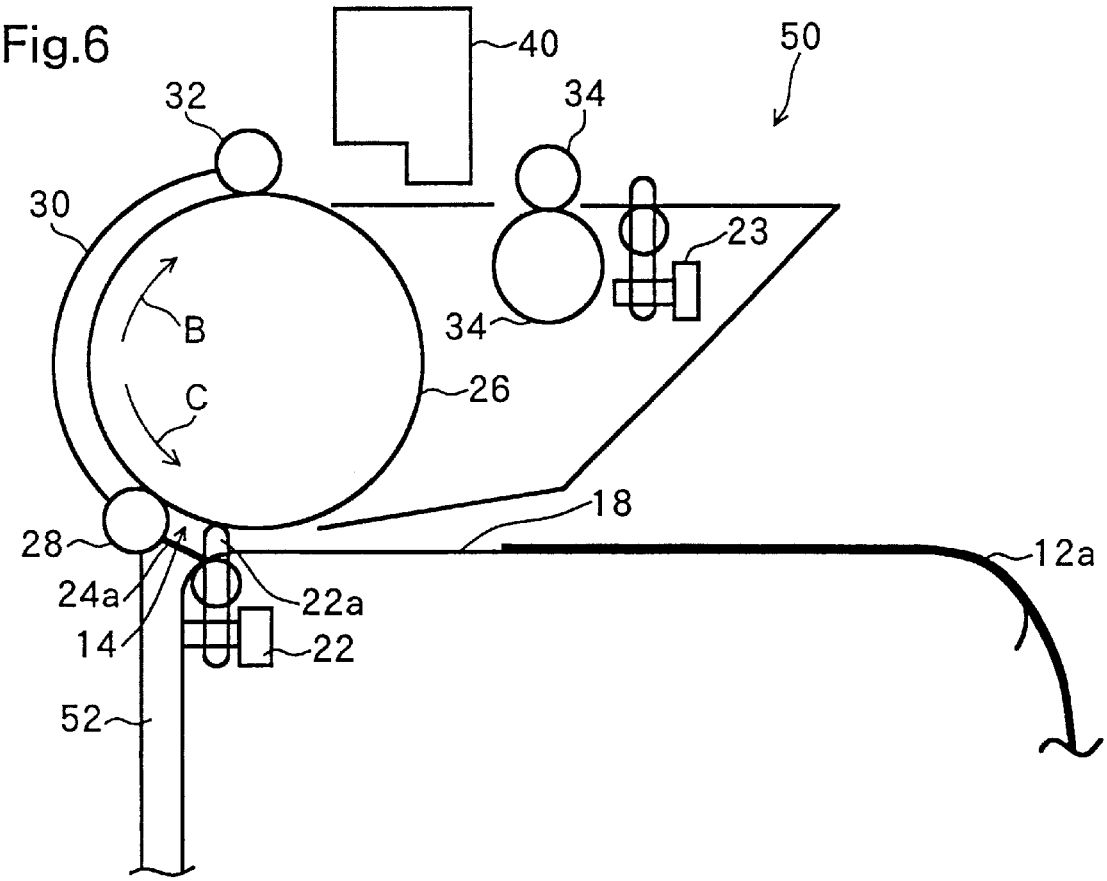
FIG. 6 illustrates schematically an ink-jet type image formation apparatus of a second embodiment of the present invention in a state that the front end of a recording medium is placed in a first passage.

FIG. 6 illustrates schematically an ink-jet type image formation apparatus of a second embodiment of the present invention in a state that the front end of a recording medium is placed in a first passage. FIG. 7 illustrates schematically the ink-jet type image formation apparatus shown in FIG. 6 in a state that the rear end of the recording medium is being detected. FIG. 8 illustrates schematically the ink-jet type image formation apparatus shown in FIG. 6 in a state that the recording medium is guided to a second passage. In these drawings, the same symbols and numerals are used for the corresponding constitutional elements as in FIG. 1.

The ink-jet type image formation apparatus 50 is characterized in that second passage 52 communicating with insertion port 14 is arranged so as to extend downward from the vicinity of driving roller 26. Second passage 52 is directed nearly perpendicularly to first passage 18, and insertion port 14 is communicated selectively to one of first passage 18 and second passage 18 by intercepting member 24.

The procedure of measuring the length of recording medium 12 and forming an image on recording medium 12 is similar to that described by reference to FIGS. 1–4. For returning recording medium 12 back to the standby state by reverse rotation of driving roller 26, interception plate 24*a* of intercepting member 24 intercepts the communication between first passage 18 and insertion port 14, and allows communication only between second passage 52 and insertion port 14, whereby recording medium 12 is guided to the second passage. This prevents winding of rear end portion 12*b* of recording medium 12 by front end portion 12*a* thereof to enter discharge port 16, and prevent paper jamming.

A third embodiment of the image formation apparatus of the present invention is explained below by reference to FIGS. 9–12.

Figure 9:
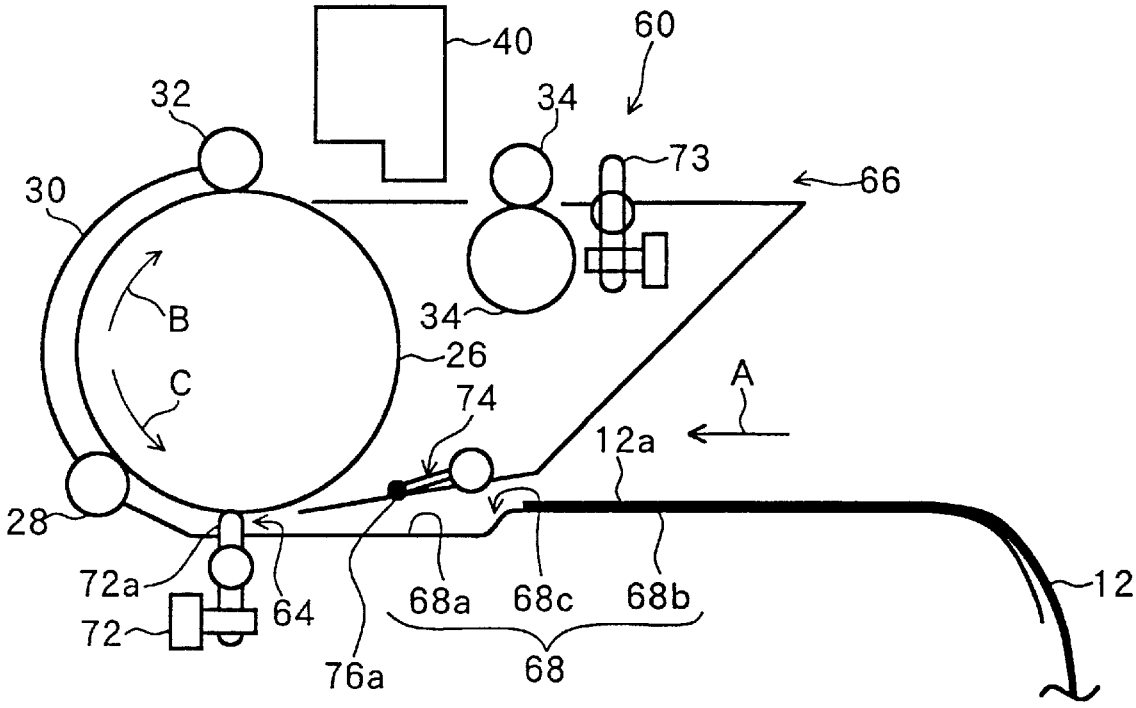
FIG. 9 illustrates schematically an ink-jet type image formation apparatus of a third embodiment of the present invention in a state that the front end of a recording medium is placed on an insertion table at a portion thereof distant from the insertion port.
Figure 10:
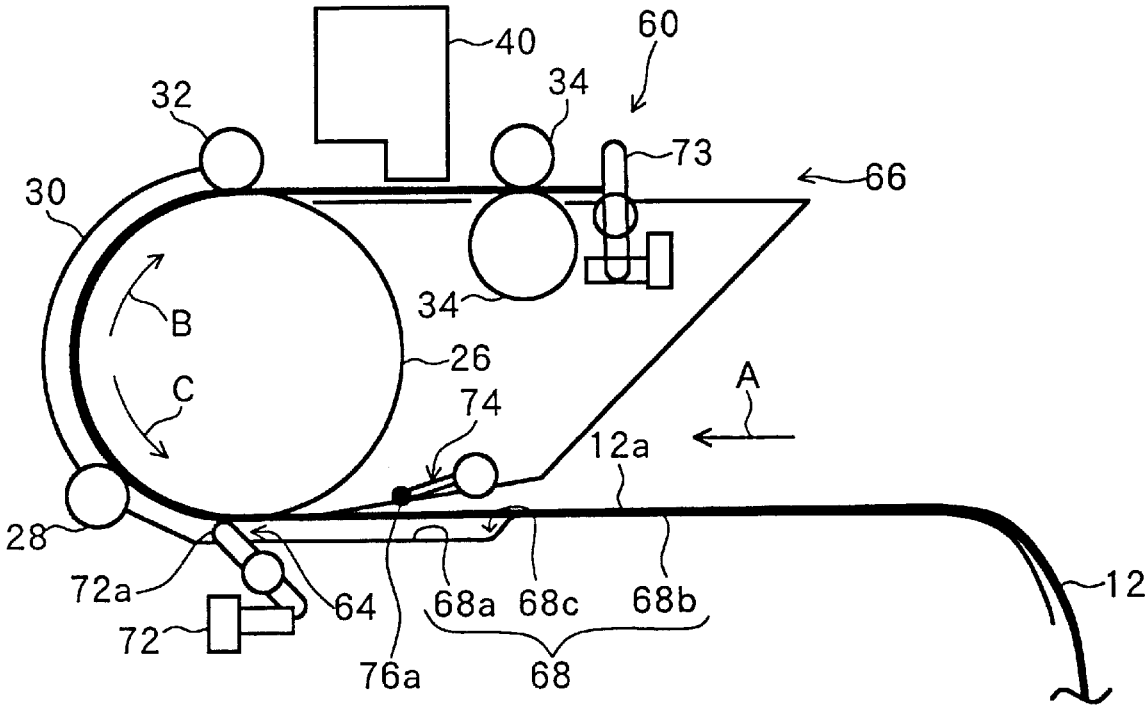
FIG. 10 illustrates schematically a state of a recording medium just before the front end thereof reaches a detection sensor at a discharge port.
Figure 11:
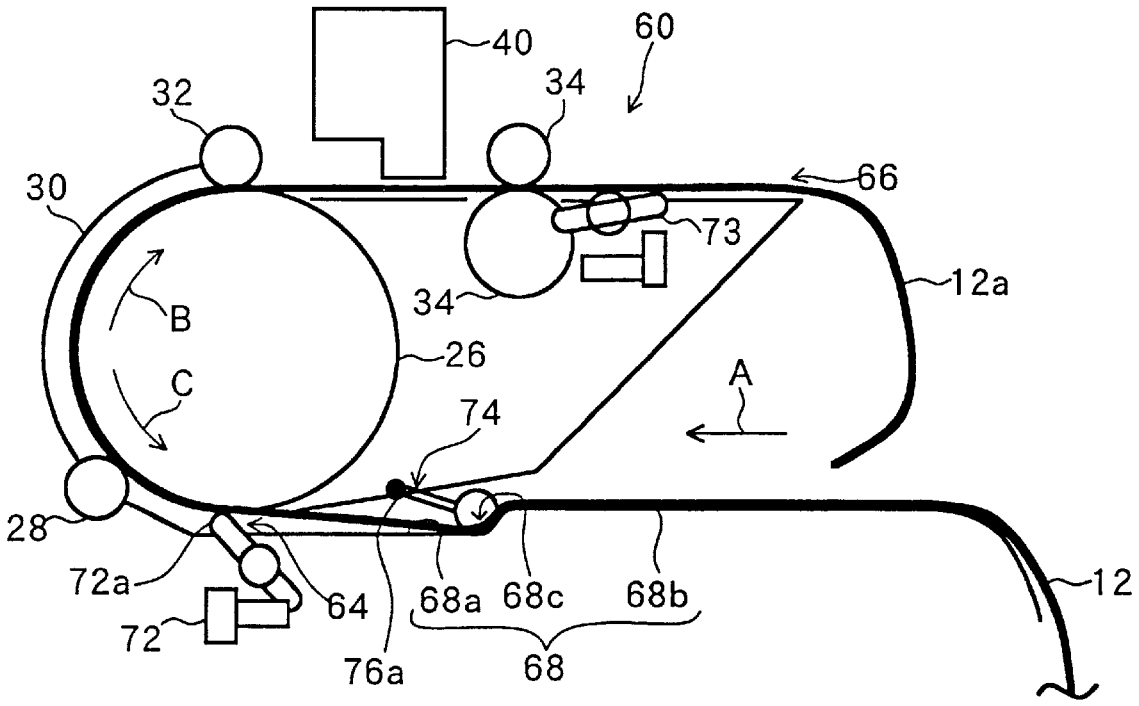
FIG. 11 illustrates schematically a state of a recording medium hanging down from the discharge port.
Figure 12:
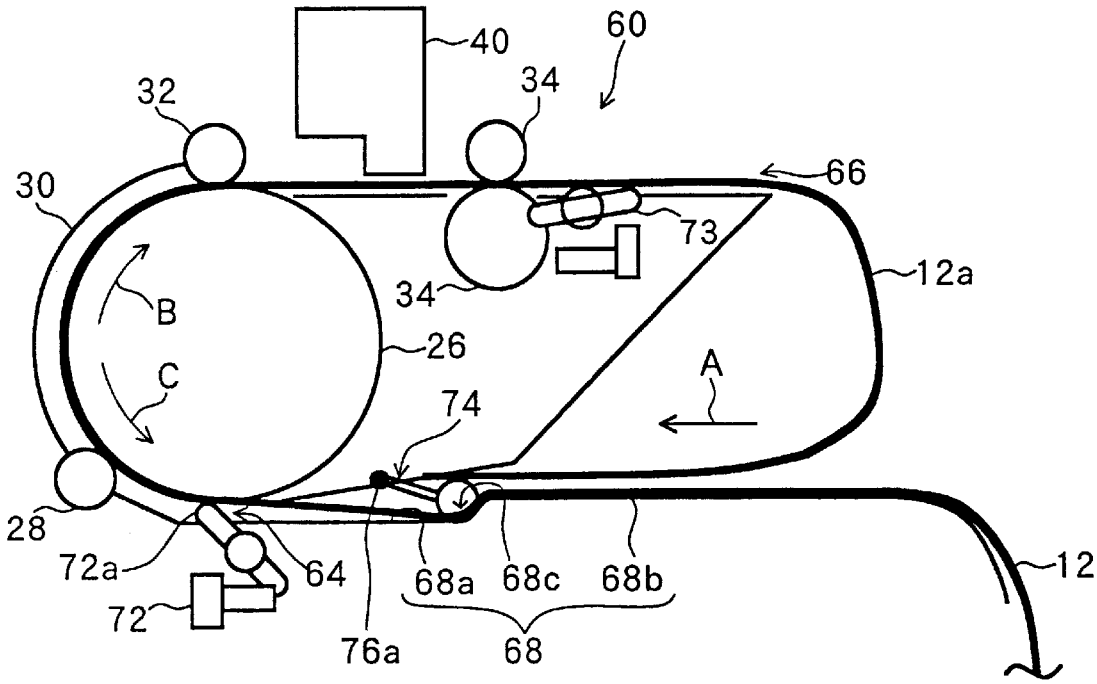
FIG. 12 illustrates schematically a state that the front end of a recording medium brought onto the insertion table is blocked by a blocking member.

FIGS. 9–12 illustrate schematically constitution of an ink-jet type image formation apparatus of a third embodiment of the present invention. FIG. 9 illustrates a state that the front end of a recording medium is placed on an insertion table at a portion thereof distant from an insertion port. FIG. 10 illustrates a state of a recording medium just before the front end thereof reaches a detection sensor at a discharge port. FIG. 11 illustrates a state of a recording medium hanging down from the discharge port. FIG. 12 illustrates schematically a state that the front end of a recording medium brought onto the insertion table is blocked by a blocking member.

The ink-jet type image formation apparatus 60 has insertion port 64 for insertion of recording medium 12 and discharge port 66 for discharging recording medium 12 provided on the same side, and additionally insertion table 68 for introducing recording medium 12 into insertion port 64 on the same side as discharge port 66 for discharging recording medium 12. Insertion table 68 has two portions: a portion 68*a* near to insertion port 64 and another portion 68*b* distant from insertion port 64, the nearby portion 68*a* being lower by about 5 mm than the distant portion 68*b*. Therefore, stair (level difference) 68*c* is formed at the border between nearby portion 68*a* and distant portion 68*b*. Above stair 68*c*, there is provided blocking member 74 which blocks the space communicating with insertion port 64 in the vicinity of stair 68*c* at a prescribed timing. This blocking member 74 is described later by reference to FIGS. 13–14.

Detection sensor (photointerrupter) 72 is provided in the vicinity to insertion port 64 for detection of recording medium 12. The front ends and the rear ends of a sheet of recording medium 12 is detected by this detection sensor 72. The length of recording medium 12 is derived by treating the detection signals with a computing element (not shown in the drawing).

Another detection sensor (photointerrupter) 73 is provided for detection of recording medium 12 between discharge roller and discharge port 66. In the region between delivery roller 32 and discharge roller 34, printing head 40 is provided which ejects ink with reciprocating movement in a direction perpendicular to the drawing paper sheet of FIG. 9 to form an image. Driving roller 26 is constructed so as to rotate in the directions shown by arrows B and C.

The process is explained for forming an image on recording medium 12 by ink-jet type image formation apparatus 60 by reference to FIGS. 9–12.

For image formation with ink-jet type image formation apparatus 60, recording medium 12 is placed on distant portion 68*b* of insertion table 68, and is inserted in the arrow-A direction into insertion port 64 to push detection sensor 72. By pushing recording medium 12 to detection sensor 72, sensor portion 72*a* of detection sensor 72 is tilted to detect the front end of recording medium 12 and to start rotation of driving roller 26 in the arrow-B direction (normal rotation) Thereby, recording medium 12 is held between driving roller 26 and delivery roller 28, and is delivered through the interspace between driving roller 26 and guide plate 30.

For further delivery, recording medium 12 is held and delivered by a pair of discharge rollers 34 toward discharge port as shown in FIG. 10. For further delivery of recording medium 12, front end portion 12*a* of recording medium 12 is detected by detection sensor 73. At the timing of detection of the front end portion 12*a* of recording medium 12 by detection sensor 73 ("prescribed timing" in the present invention), blocking member 74 blocks communication of the space around stair 68*c* with insertion port 64. This blocking is described later by reference to FIGS. 13–14.

As described above, recording medium 12 is held and delivered by driving roller 26, delivery rollers 28,32, and discharge rollers 34, and comes to be discharged through discharge port 66. Here, if front end portion 12*a* of recording medium 12 is curled by humidity absorption or other causes, front end portion 12*a* is brought onto insertion table 68 and is introduced to insertion port 64 again following the insertion of recording medium 12.

At this time, however, as described above, the space communicating with insertion port 64 is blocked in the space around stair 68*c* by blocking member 74. Therefore, front end portion 12*a* of recording medium 12 is blocked by blocking member 74 so as not to be inserted into insertion port 64 as shown in FIG. 12. Thus, front portion 12*a* of recording medium 12 discharged from discharge port 66 is prevented from second entry into insertion port 64, not causing jamming.

Blocking member 74 is explained below by reference to FIGS. 13–14.

Figure 13:
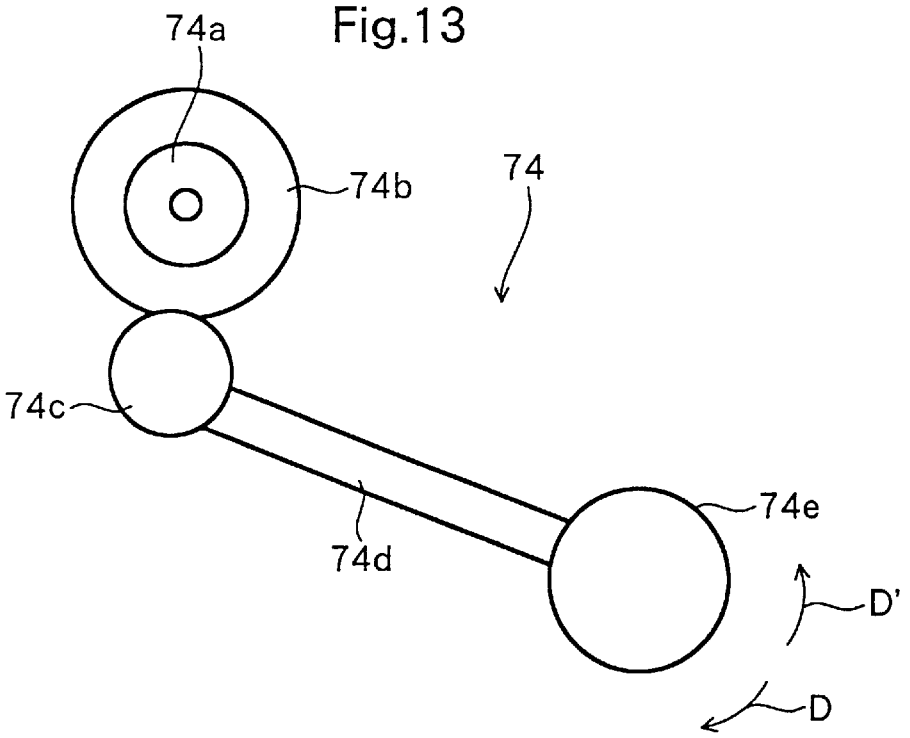
FIG. 13 illustrates schematically the blocking member.
Figure 14:
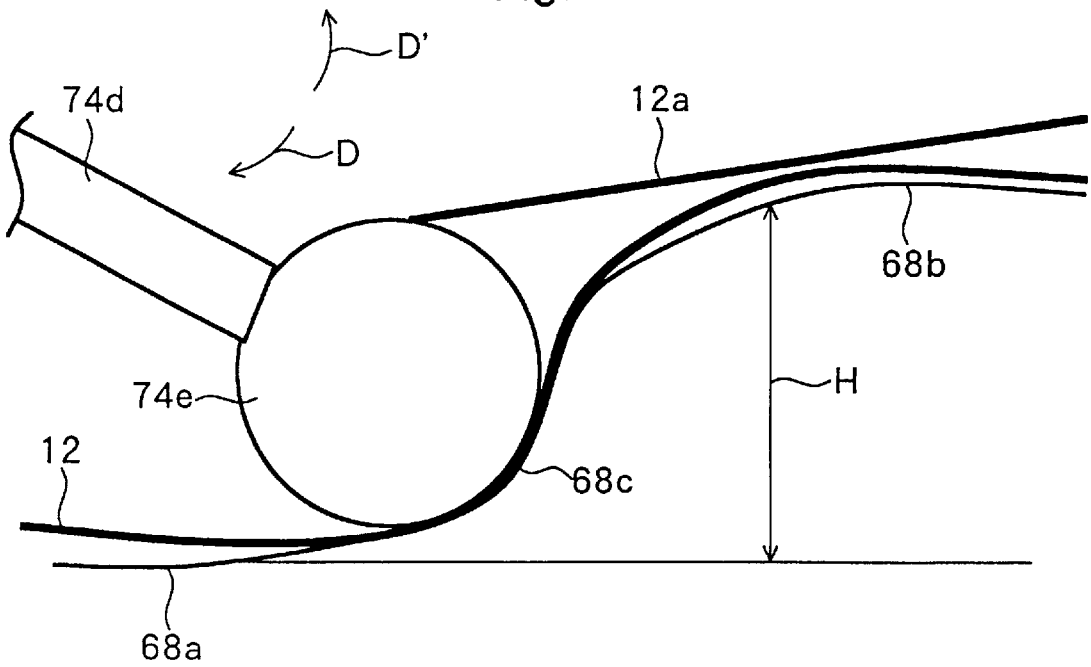
FIG. 14 illustrates enlargedly the state of a portion of the space around a stair where the space communicating with the insertion port is blocked by the blocking member.

FIG. 13 illustrates schematically blocking member 74. FIG. 14 illustrates enlargedly the state of a portion of the space around a stair 68*c* where the space communicating with insertion port 64 is blocked by the blocking member 74.

Blocking member 74 comprises motor 74*a*, and a gear 74*b* fixed to the rotation axis of this motor 74*a*. Gear 74*b* engages with gear 74*c*. Blocking plate 74*d* is fixed to the pivot of gear 74*c*, and blocking plate 74*d* is turned by rotation of motor 74*a* in the directions of arrows D and D'. At the tip of blocking plate 74*d*, delivery roller 74*e* is fixed rotatably.

After insertion of recording medium 12 from insertion table 68 (see FIG. 9), before detection of recording medium 12 by detection sensor 73, blocking plate 74*d* is placed at the position shown in FIG. 9 or FIG. 10, and the space communicating with insertion port 64 around stair 68*c* is not blocked. At the timing when front end portion 12*a* of recording medium 12 is detected by detection sensor 73, motor 74*a* starts to rotate to turn blocking plate 74*d* in the arrow-D direction. Thereby, delivery roller 74*e* comes to be fitted to stair 68*c* with a pressing force to allow the passing recording medium 12 only to pass therethrough and to block the space around stair 68*c* communicating with insertion port 64. Thus, even if front end portion 12*a* of recording medium 12 having discharged from discharge port 66 is curled, reentry of front end portion 12*a* thereof into insertion port 64 is prevented, whereby jamming is prevented.

The recording medium 12 passing through stair 68*c* is allowed to pass along stair 68*c* without inconvenience in delivery of recording medium 12. In this example, the level of portion 68*a* of insertion table 68 near insertion port 64 is made lower by about 5 mm than the level of portion 68*b* distant therefrom, whereas nearby portion 68*a* may be made higher by about 5 mm than distant portion 68*b*.

Industrial Usefulness

As described above, the image formation apparatus of the first embodiment of the present invention has a second passage provided on the side opposite to the discharge port relative to the first passage. This second passage communicates with an insertion port. Therefore, the recording medium discharged through insertion port is delivered to the second passage, whereby the recording medium discharged through insertion port is prevented from contact with the recording medium discharged through discharge port. As the result, jamming caused by winding of a part of the recording medium into discharge port is prevented.

The first passage and the second passage join together in the vicinity of the insertion port. The intercepting member, which intercepts communication between the first passage and insertion port to communicate the insertion port only with the second passage, prevents more surely the jamming caused by winding of a part of the recording medium into the discharge port.

The image formation apparatus of the second embodiment of the present invention has a blocking member for blocking, at a prescribed timing, the space which communicates with the insertion port. Therefore, even if the front end portion of the recording medium discharged from the discharge port is curled, the recording medium does not reenter the insertion port, whereby the jamming is prevented. Further, the recording medium passing through the stair is allowed to pass along the stair without inconvenience in delivery of the recording medium.

What is claimed is:

1. An image formation apparatus having an insertion port for inserting a recording medium, a driving roller and a discharge port for discharging the recording medium provided on one side of the driving roller to turn back the recording medium, and a first passage for guiding the recording medium to the insertion port also on the same side of the driving roller as the insertion port and the discharge port, wherein the apparatus has, on the side opposite to the discharge port relative to the first passage, a second passage which communicates with the insertion port and guides only the recording medium delivered back after passing through the first passage.

2. The image formation apparatus according to claim 1, wherein the first passage and the second passage join together near the insertion port, and an intercepting member is provided which intercepts the communication between the first passage and the insertion port at a prescribed timing to allow the insertion port to communicate with the second passage only.

3. An image formation apparatus having an insertion port for inserting a recording medium, a driving roller and a discharge port for discharging the recording medium provided on one side of the driving roller to turn back the recording medium, and a first passage for guiding the recording medium to the insertion port also on the same side of the driving roller as the insertion port and the discharge port, wherein the apparatus has a second passage which communicates with the insertion port and extends in a direction nearly perpendicular to the first passage, and guides only the recording medium delivered back after passing through the first passage, and wherein said second passage is on an opposite side of the first passage relative to the discharge port.

4. The image formation apparatus according to claim 3, wherein the first passage and the second passage join together near the insertion port, and an intercepting member is provided which intercepts the communication between the first passage and the insertion port at a prescribed timing to allow the insertion port to communicate with the second passage only.

5. An image formation apparatus having an insertion port for inserting a recording medium, a driving roller and a discharge port for discharging the recording medium provided on one side of the driving roller to turn back the recording medium, and an insertion table for guiding the recording medium to the insertion port also on the same side of the driving roller as the insertion port and the discharge port, wherein the insertion table has a stair, near the insertion port and a blocking member is provided which presses the recording medium being delivered and blocks a space communicating with the insertion port at a prescribed timing at or around the stair.

* * * * *